US009074448B2

(12) United States Patent
Gette et al.

(10) Patent No.: US 9,074,448 B2
(45) Date of Patent: Jul. 7, 2015

(54) PIN-ACTUATED LOCK RING ARRANGEMENT

(75) Inventors: Nicholas Peter Gette, Houston, TX (US); David Lawrence Ford, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 243 days.

(21) Appl. No.: 13/612,509

(22) Filed: Sep. 12, 2012

(65) Prior Publication Data

US 2014/0069631 A1 Mar. 13, 2014

(51) Int. Cl.
*E21B 33/03* (2006.01)
*E21B 33/04* (2006.01)

(52) U.S. Cl.
CPC ..... *E21B 33/04* (2013.01); *E21B 33/03* (2013.01)

(58) Field of Classification Search
CPC ..... E21B 33/038; E21B 33/04; E21B 33/03
USPC ..... 166/75.14, 96.1, 382
See application file for complete search history.

(56) References Cited

U.S. PATENT DOCUMENTS 4,595,053 A 6/1986 Watkins et al.
4,691,781 A * 9/1987 Gano ..... 166/368
4,757,860 A 7/1988 Reimert
5,301,750 A * 4/1994 Watkins ..... 166/208
5,421,407 A 6/1995 Thornburrow
5,456,314 A 10/1995 Boehm, Jr. et al.
5,456,321 A * 10/1995 Shiach et al. ..... 166/382
6,234,252 B1 * 5/2001 Pallini et al. ..... 166/345
6,749,018 B1 6/2004 Ford et al.
7,240,735 B2 * 7/2007 Crozier ..... 166/344
7,762,319 B2 7/2010 Nelson
8,347,970 B2 * 1/2013 Vanderford et al. ..... 166/379
2001/0045286 A1 * 11/2001 Pallini et al. ..... 166/345
2012/0025470 A1 2/2012 Gette

FOREIGN PATENT DOCUMENTS

EP 2189620 A1 5/2010
GB 2408989 A 6/2005

OTHER PUBLICATIONS

PCT Search Report and Written Opinion issued Jun. 12, 2014 in connection with corresponding PCT Patent Application No. PCT/U52013/058731.

* cited by examiner

*Primary Examiner* — Kenneth L Thompson
(74) *Attorney, Agent, or Firm* — Bracewell & Giuliani LLP

(57) ABSTRACT

In a wellhead near the top of an oil and gas well, a locking ring assembly for locking an inner tubular wellhead member axially relative to an outer tubular wellhead member. The inner tubular member has a circumferential recess that contains a locking ring. After insertion of the inner tubular member into the outer tubular member, actuating pins radially expand the locking ring so that it partially leaves the circumferential recess and engages a corresponding recess in the outer tubular member. The pins may be deployed by a seal inserted above the inner tubular member.

17 Claims, 5 Drawing Sheets

PIN-ACTUATED LOCK RING ARRANGEMENT

BACKGROUND OF THE INVENTION

1. Field of the Invention

This invention relates generally to locking rings for securing inner wellhead tubular members to outer wellhead tubular members. More particularly, this invention relates to a locking ring on an inner wellhead tubular member that is actuated by a series of pins that may be compressed by an annulus seal and that, when compressed, pushes the locking ring into engagement with the outer wellhead tubular member.

2. Brief Description of Related Art

Typically, locking mechanisms are used between inner and outer wellhead tubular members to help prevent relative axial movement between the members. In some cases, such locking mechanisms are integrated with seals or packoffs, which are typically used as a pressure barrier in the annular space between the inner and outer tubular members.

For example, U.S. Patent Appln. Pub. No. 2012/0025470 discloses an arrangement that includes a casing hanger inserted in a well bore. An annular seal is inserted so as to seal the space between the casing hanger and the well bore. To accomplish this, the annular seal includes ridges that, when pressed against surfaces of the casing hanger and the wellbore, become embedded in the surfaces. Not only does this arrangement seal the space between the casing hanger and the well bore, but it also locks the casing hanger in place axially relative to the wellbore.

One characteristic of such an integrated sealing/locking arrangement, is that ridges perform both a sealing and a locking function. Such an arrangement is advantageous in certain applications. It is possible, however, that there may be annulus seal designs that would perform the sealing function well, but that do not have the required profile to lock the casing hanger relative to the well bore. Another characteristic of such an integrated sealing/locking arrangement, is that the ridges, which lock the casing hanger in place by engaging the walls of the casing hanger and the well bore, are positioned in the load path for lockdown. Again, this feature is advantageous in certain applications. In some instances, however, it may be desirable to have a locking mechanism that is separate from the annulus seal, and not located in the load path. Such a situation may arise, for example, where there is a need to increase resistance to fatigue and the reliability of the seal.

SUMMARY OF THE INVENTION

Disclosed herein is a wellhead having a locking ring assembly for locking an inner tubular member, such as a casing hanger, axially relative to an outer tubular member, such as a well bore. The assembly includes a radially expandable locking ring that is substantially contained in a recess around the circumference of the inner tubular member. The ring has an unlocked position, in which it is substantially fully seated within the recess, and a locked position, in which it expands at least partially out of the recess and into engagement with a corresponding recess in the outer tubular member. When in the locked position, the ring prevents the inner tubular member from moving axially relative to the outer tubular member.

The ring may be actuated by an actuating mechanism that substantially surrounds the inner tubular member and slides axially between an up position and a down position. When in the up position, the actuating mechanism is substantially disengaged from the locking ring so that the locking ring can remain in its unlocked position within the recess of the inner tubular member. Conversely, when in the down position, the actuating mechanism may at least partially displace the locking ring from the recess, forcing the locking ring to expand into a locked position and engage the recess of the outer tubular member.

In one example embodiment the actuating member may be a series of pins that are substantially vertically oriented around the circumference of the inner tubular member. In another embodiment, the actuating member may be a ring that surrounds the inner tubular member.

Further disclosed herein is a method of locking a casing hanger to a wellhead, where a casing hanger having a recess around its circumference, and a radially expandable locking ring within the recess, is inserted into a well bore. Thereafter, an actuating mechanism may be employed to expand the locking ring so that it engages a recess of the well bore, thereby locking the casing hanger axially relative to the well bore. In an example embodiment, the actuating mechanism may be deployed by an annular seal inserted into the well bore above the casing hanger. As discussed above with respect to the locking ring assembly, the actuating mechanism may be a series of pins surrounding the casing hanger. Alternatively, it may be a ring that surrounds the inner tubular member.

BRIEF DESCRIPTION OF THE DRAWINGS

The present invention will be better understood on reading the following detailed description of nonlimiting embodiments thereof, and on examining the accompanying drawings, in which.

DETAILED DESCRIPTION OF THE PREFERRED EMBODIMENT

Figure 1:
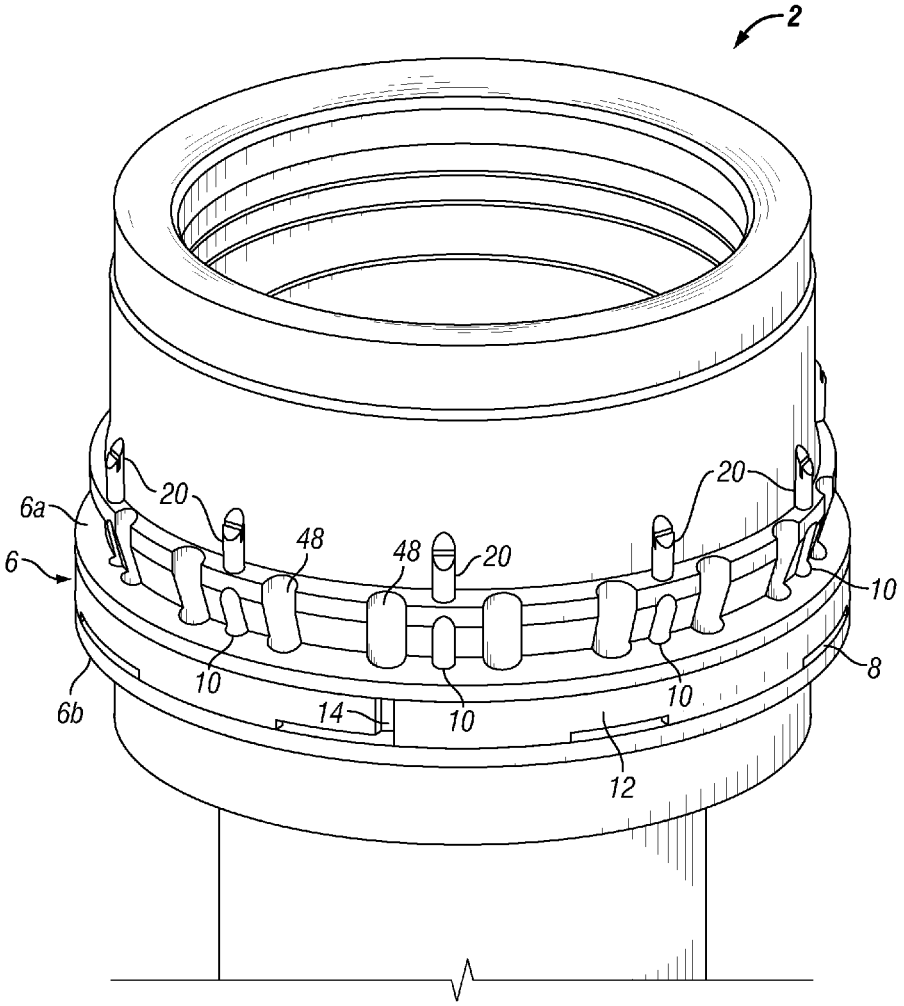
FIG. 1 is a perspective view of an example embodiment of a casing hanger including a pin actuated locking ring assembly.

The foregoing aspects, features, and advantages of the present invention will be further appreciated when considered with reference to the following description of preferred embodiments and accompanying drawings, wherein like reference numerals represent like elements. In describing the preferred embodiments of the invention illustrated in the appended drawings, specific terminology will be used for the sake of clarity. However, the invention is not intended to be limited to the specific terms used, and it is to be understood that each specific term includes equivalents that operate in a similar manner to accomplish a similar purpose.

The present technology may be used in oil and gas wells, and in particular in wellheads at the top of the wells. Typical wellheads may serve a number of different functions, including casing suspension, tubing suspension, pressure sealing, and so forth. Some of these functions require an inner well member, such as, for example, a casing hanger, to be inserted into the wellhead and locked axially relative to the wellhead.

Referring to FIG. 1, there is shown a perspective view of an inner tubular member, which is, in the example embodiment shown, a casing hanger 2 according to one example embodiment of the present technology. As can be seen, the casing hanger 2 of this embodiment is substantially cylindrical and has a circumferential protrusion 6 extending from the outer surface thereof. The circumferential protrusion 6 has an upper portion 6*a* and a lower portion 6*b*, and defines a circumferential recess 8 and a plurality of holes 10. In the embodiment of FIG. 1, the circumferential recess 8 is positioned below at least one debris trap 48 located on the casing hanger 2. The holes 10 are more clearly shown in FIGS. 2-4, where it is apparent that each hole 10 has a longitudinal axis that is angled radially inward. In some embodiments, the longitudinal axis of each hole may be nearly vertical or vertical. Each hole 10 extends through an upper portion 6*a* of the circumferential protrusion and intersects the circumferential recess 8 at a back end thereof.

As further shown in FIG. 1, a locking ring 12 may be positioned within the recess 8, and axially restrained by upper and lower portions 6*a*, 6*b* of the circumferential protrusion 6. The locking ring 12 has an inner surface 40 and an outer surface 42 (shown in FIG. 2). In its neutral state, the locking ring 12 is biased so that it is substantially fully seated within the recess 8. However, the locking ring 12 also has a notch 14 that allows the ring 12 to expand radially outwardly from the outer surface of the casing hanger 2. Such expansion of the locking ring 12 may occur, for example, if an outward force is exerted against the inner surface 40 of the ring 12, or if an object enters the recess 8 inside the inner surface 40, thereby displacing the ring 12 and forcing it to expand radially outward. In addition, the locking ring 12 may have shoulders 16 (best shown in FIG. 2). A crush washer 18 (also shown in FIG. 2) may be positioned between the locking ring 12 and the lower portion 6*b* of the circumferential protrusion.

In the example embodiment shown in FIG. 1, a plurality of pins 20 may be inserted at least partially into the holes 10. The pins 20 may be elongate, and, like the holes 10, have a longitudinal axis that is angled radially inward. The pins 20 may be at least partially supported in their vertical position by the holes 10, and may further be oriented and retained in position by a dowel pin 22 that engages a grooved slot 24 in each pin (shown in FIG. 2), or by similar means. The dowel pin 22 may have an axis that is substantially perpendicular to the axis of the each pin 20, and passes through the grooved slot 24 in each pin and into the casing hanger 2. The grooved slot 24 is preferably elongate so that the pin may move up and down in an axial direction while the dowel is engaged with the slot 24. The pins 20 are axially moveable relative to the casing hanger 2 and have at least an up position (shown FIG. 3) and a down position (shown in FIGS. 2 and 4). When in the up position, the pin 20 does not extend into the lower portion of the hole 10, which intersects the recess 8. When in the down position, however, the pin 20 may extend at least partially into the tower portion of the hole 10, which causes the pin 20 to come into contact with, and at least partially displace the locking ring 12.

Figure 2:
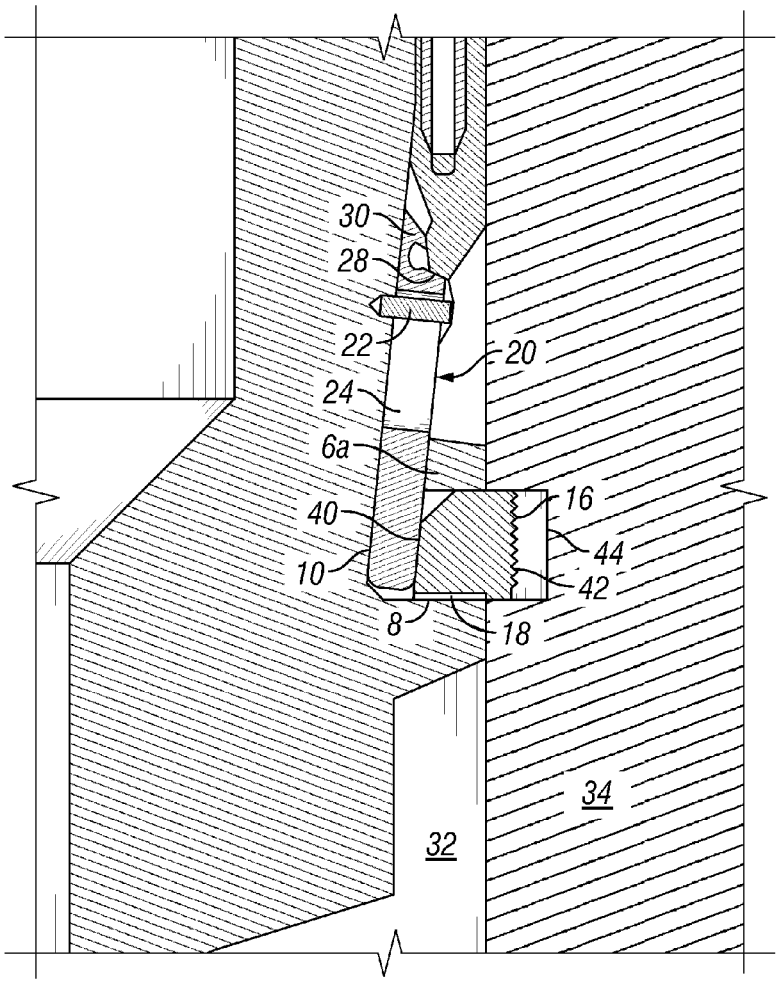
FIG. 2 is an enlarged cross-section side view of a portion of the pin actuated locking ring assembly, with the pin in the down position and the locking ring in the locked position.

Referring now to FIG. 2, it can be seen that each pin 20 may have a contoured upper surface. For example, each pin 20 may have a push surface 28, which may slope downward with distance radially outward. In addition, each pin 20 may have a retrieval tooth 30 to aid in moving the pin from a down position to an up position, as described in detail below. The tooth 30 projects upward from the push surface 28 and includes a notch with a downward facing surface for selectively applying an upward lifting force.

Figure 3:
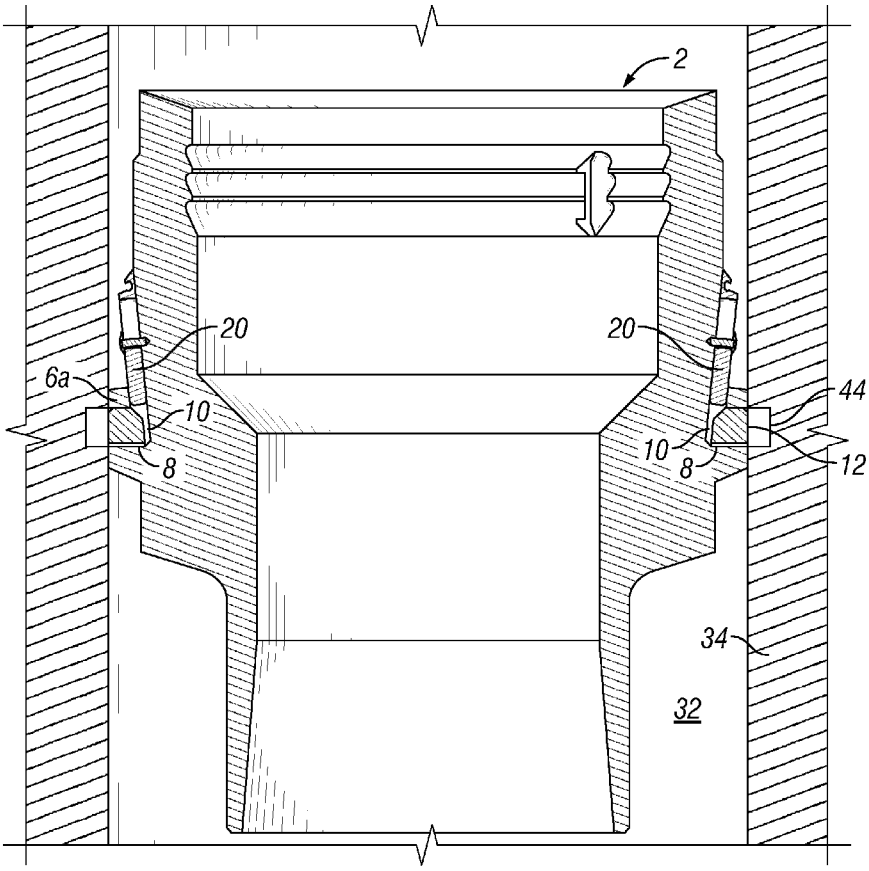
FIG. 3 is a cross-sectional side view of a casing hanger including a pin actuated locking ring assembly, with the pins in the up position, and the locking ring in the unlocked position.

In one non-limiting example, the locking ring of the present technology may lock a casing hanger in place relative to wellhead tubing according to the following method. After the casing hanger 2 is inserted into a bore 32 of a wellhead 34, the pins 20 and locking ring 12 are configured as shown in FIG. 3, with the pins 20 in the up position, and the locking ring 12 fully seated within the recess 8. The casing hanger 2 and the wellhead 34 define a portion of a well head assembly.

Figure 4:
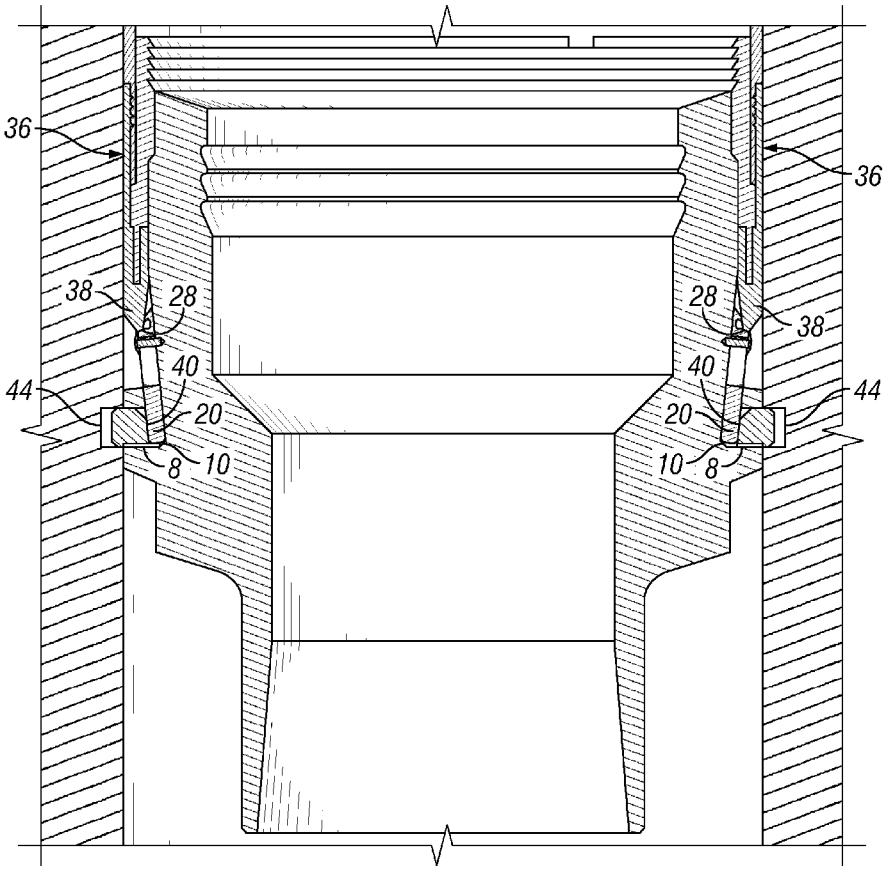
FIG. 4 is a cross-sectional side view of a casing hanger including a pin actuated locking ring assembly, also including the annulus seal, and with the pins in the down position, and the locking ring in the locked position.

Next, as shown in FIG. 4, an annulus seal 36 is inserted into the bore 32 to circumscribe in upper end of the casing hanger 2. As the annulus seal 36 is lowered, the lower ends 38 of the annulus seal 36 contact the push surfaces 28 of the pins and begin to push down, or compress, the pins 20 relative to the casing hanger 2. As the pins 20 are pushed down, the bottom end of each pin 20 enters the lower portion of its hole 10, which intersects the back of the recess 8. As the pin 20 contacts the inner surface 40 of the locking ring 12, it exerts an outward force on the ring 12, and displaces the ring 12 at least partially from the recess 8. Accordingly, the ring 12 expands radially outward, and its outer surface 42 extends beyond the recess 8 and into locking engagement with a recess 44 in the wellhead wall. The recess 44 is configured to receive the locking ring 12 and interferes with axial movement of the locking ring 12. Thus, with the pins 20 in the down position, the locking ring 12 is in a locked position, and the casing hanger 2 is fixed axially in place relative to the wellbore.

In the event that the casing hanger 2 needs to be retrieved from the wellbore, the following process may be employed. First, the annulus seal 36 may be removed from the bore 32. Thereafter a running tool (not shown) may be inserted into the bore. The running tool should have means to engage the retrieval teeth 30 of the pins 20. The running tool is lowered over the top of the casing hanger 2 until it engages each of the retrieval teeth 30. Thereafter the running tool is raised, thereby exerting an upward force on the retrieval teeth 30 and moving the pins 20 into the up position. As the pins 20 move into the up position, the ends of the pins 20 move out of the bottom portions of the holes 10 and cease to displace the locking ring 12. Accordingly, the locking ring 12 contracts back into the recess 8 and disengages from the recess 44 in the wellhead wall. With the locking ring 8 thus disengaged, the casing hanger 2 may move axially relative to the wellhead and can be withdrawn from the well. In an alternative embodiment, the annular seal 36 itself may be equipped with means for engaging the retrieval teeth 30 and may pull the pins 20 into the up position, thereby eliminating the need to insert a separate running tool.

Figure 5:
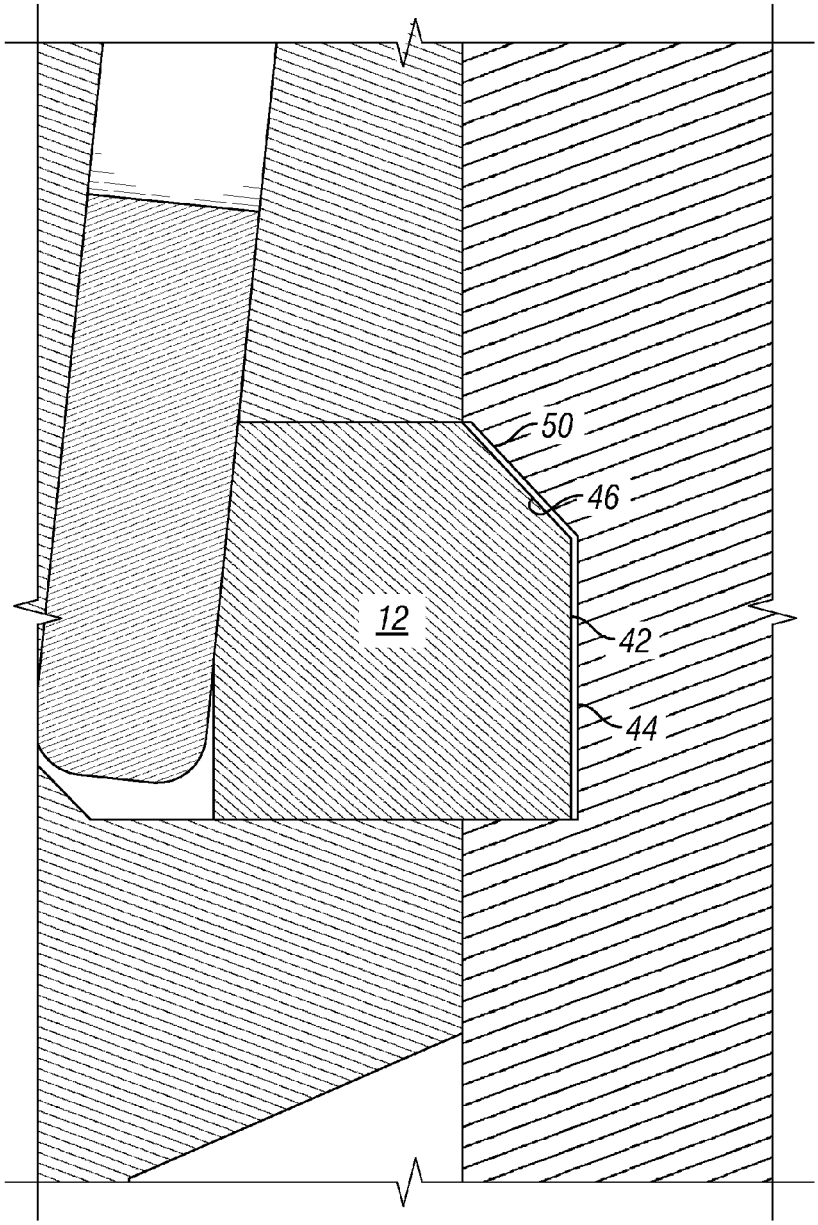
FIG. 5 is an enlarged cross-sectional side view of a casing hanger and a wellhead with the pin in the down position and the locking ring in the locked position, where the locking ring and the recess in the wellhead have corresponding chamfered, or angled surfaces.

Referring to FIG. 5, there is shown an alternate embodiment where the locking ring 12 has a chamfered surface 46 at an upper end of the outer surface 42. In such an embodiment, the recess 44 in the wellhead wall may have an angled surface 48 that corresponds to the chamfered surface 46 when the locking ring 12 is extended into its locked position. Such a chamfered surface 46 may ease the entry of the locking ring 12 into the recess 44 in situations where, for example, the locking ring 12 is not exactly aligned with the recess 44 when the locking ring expands. In addition, the locking ring 12 may have a chamfered surface at a bottom end of the outer surface 42 (not shown). In fact, the locking ring 12 may have any profile that will allow locking engagement with the recess 44 of the wellhead.

Although the above example embodiments use pins to displace the locking ring 12 and expand it into locked engagement with the recess 44 in the wellhead wall, it is to be understood that other ring actuating mechanisms are also contemplated by the present invention. For example, instead of pins, one example embodiment employs a tapered ring (not shown) that has an up position and a down position. Similar to the pins disclosed above, when the tapered ring is in the down position it is configured to at least partially displace the locking ring 12 from the recess 8 and into locked engagement with the wellhead wall. Conversely, when the tapered ring is in the up position, it ceases to displace the ring 12 from the recess 8, and the ring contracts back into the recess 8.

One advantage to the pin actuated locking rings is that, unlike some known locking rings, the pin actuated locking rings of the present technology does not share a profile with the back-up seal of an annulus seal. Thus, there is more room for back-up sealing geometry, thereby allowing for more flexibility in the design and location of the back-up seal. In addition, with the above disclosed design, the load path for lockdown need not run through the annulus seal. Accordingly, the reliability and resistance to fatigue of the annulus seal will be improved. Furthermore, the locking rings disclosed herein allow for a secure lockdown of the casing hanger without modification of the annulus seal, thereby eliminating the need for time consuming and costly testing of alternative annulus seal designs.

While the invention has been shown or described in only some of its forms, it should be apparent to those skilled in the art that it is not so limited, but is susceptible to various changes without departing from the scope of the invention. For example, although the example embodiments have disclosed use of the locking ring with a casing hanger, the inner tubular member could instead be a tubing hanger, plug, safety valve, or other device. Furthermore, it is to be understood that the above disclosed embodiments are merely illustrative of the principles and applications of the present invention. Accordingly, numerous modifications may be made to the illustrative embodiments and other arrangements may be devised without departing from the spirit and scope of the present invention as defined by the appended claims.

What is claimed is:

1. A locking ring assembly for locking together inner and outer wellhead tubulars, comprising:

a circumferential protrusion that selectively circumscribes the inner wellhead tubular;

a recess along an outer circumference of the circumferential protrusion;

an elongate pin that axially inserts into the recess;

a locking ring in the recess that expands radially outward into interfering contact with a recess in the outer wellhead tubular and the recess in the inner wellhead tubular when the pin inserts into the recess; and a seal configured for insertion between the inner wellhead tubular and the outer wellhead tubular for contacting an upper end of the pin and exerting an axial force on the pin for inserting the pin into the recess.

2. The locking ring assembly of claim 1, further comprising an elongate hole in the circumferential protrusion and in which the pin inserts.

3. The locking ring assembly of claim 1, wherein the pin has a contoured upper surface with a retrieval tooth configured for engagement with a retrieval tool, so that when the retrieval tool is engaged with the retrieval tooth of the pin, and moves upwardly toward the top of the outer wellhead tubular, the pin will be removed from the recess.

4. The locking ring assembly of claim 1, further comprising a frangible dowel that projects through the pin and into the inner wellhead tubular.

5. The locking ring assembly of claim 1, further comprising at least one debris trap located on the outer surface of the inner tubular member above the circumferential recess.

6. The locking ring assembly of claim 1, further comprising a crush washer positioned between the locking ring and the circumferential recess.

7. A pin activated locking ring assembly for locking a casing hanger to the bore of a wellhead, comprising:

a circumferential protrusion around the casing hanger that is circumscribed by a recess;

a radially expandable locking ring in the recess that is selectively moved radially outward so that a portion of the locking ring enters a recess in the wellhead to axially couple the casing hanger and the wellhead;

a plurality of axially movable pins for selectively moving the locking ring radially outward; and an annular seal configured for insertion in the bore after the casing hanger, the annular seal having a lower end, wherein the pins each have a contoured upper surface configured for engagement with the lower end of the annular seal so that as the annular seal is inserted into the wellbore, the lower end push the pins downward so that the pins urge the locking ring radially outward.

8. The locking ring assembly of claim 7, wherein the contoured upper surface of each pin has a retrieval tooth configured for engagement with a retrieval tool, so that when the retrieval tool is engaged with the retrieval tooth of each pin and moves upwardly toward the top of the bore, each pin will be moved upward.

9. The locking ring assembly of claim 7, further comprising bores in the circumferential protrusion in which the pins are inserted.

10. The locking ring assembly of claim 7, further comprising at least one debris trap located on the outer surface of the casing hanger above the circumferential recess.

11. The locking ring assembly of claim 7, further comprising a crush washer positioned between the locking ring and the circumferential recess.

12. A wellhead assembly, comprising:

a wellhead housing;

a casing hanger inserted in the wellhead housing; and a locking ring assembly for locking together the casing hanger and the wellhead housing, the locking ring assembly comprising:

a circumferential protrusion that selectively circumscribes the casing hanger;

a recess along an outer circumference of the circumferential protrusion;

an elongate pin that axially inserts into the recess;

a locking ring in the recess that expands radially outward into interfering contact with a recess in the wellhead housing and the recess in the circumferential protrusion of the casing hanger when the pin inserts into the recess; and a seal configured for insertion between the casing hanger and the wellhead housing for contacting an upper end of the pin and exerting an axial force on the pin for inserting the pin into the recess.

13. The wellhead assembly of claim 12, further comprising an elongate hole in the circumferential protrusion and in which the pin inserts.

14. The wellhead assembly of claim 12, wherein the pin has a contoured upper surface with a retrieval tooth configured for engagement with a retrieval tool, so that when the retrieval tool is engaged with the retrieval tooth of the pin, and moves upwardly toward the top of the wellhead housing, the pin will be removed from the recess.

15. The wellhead assembly of claim 12, further comprising a frangible dowel that projects through the pin and into the casing hanger.

16. The wellhead assembly of claim 12, further comprising at least one debris trap located on the outer surface of the casing hanger above the circumferential recess.

17. The wellhead assembly of claim 12, further comprising a crush washer positioned between the locking ring and the circumferential recess.

* * * * *